US005080360A

United States Patent [19]

Longeat

[11] Patent Number: 5,080,360

[45] Date of Patent: * Jan. 14, 1992

[54] EQUIPMENT FOR STRINGING A TENNIS RACKET

[75] Inventor: Gérard Longeat, Lyons, France

[73] Assignee: Babolat VS, Lyons, France

[ * ] Notice: The portion of the term of this patent subsequent to Jun. 25, 2008 has been disclaimed.

[21] Appl. No.: 686,364

[22] Filed: Apr. 17, 1991

Related U.S. Application Data

[63] Continuation of Ser. No. 470,739, Jan. 26, 1990, Pat. No. 5,026,055.

[30] Foreign Application Priority Data

Feb. 7, 1989 [FR] France ..... 89 01920

[51] Int. Cl.[5] ..... A63B 51/14

[52] U.S. Cl. ..... 273/73 A; 273/73 R

[58] Field of Search ..... 273/73 R, 73 A, 73 B

[56] References Cited

U.S. PATENT DOCUMENTS 4,706,955 11/1987 Ngadi et al. ..... 273/73 A

FOREIGN PATENT DOCUMENTS 0136245 4/1985 European Pat. Off. ..... 273/73 A
2243272 12/1974 Fed. Rep. of Germany .
43577 7/1934 France .
2612409 9/1988 France .

*Primary Examiner*—Edward M. Coven
*Assistant Examiner*—Raleigh W. Chiu
*Attorney, Agent, or Firm*—Oliff & Berridge

[57] ABSTRACT

Racket stringing equipment having movable jaws, for holding the racket on the stringing cradle as the racket is strung, includes profiled gripping jaws to bring the string mesh plane of the racket into alignment with a predefined stringing plane. The string tensioner holds the string being applied to the racket in a raised position in alignment with the reference stringing plane, as the racket is being strung. The string tensioner moves to a retracted position as the stringing cradle is rotated, to allow the handle of the racket to pass over the string tensioner, and returns to the raised position when the racket handle has passed. The clips for holding tension in the strings strung on the racket are freely rotatably mounted on a rotatable satellite arm. An electromagnetic lock simultaneously locks the satellite arm and the mounting arm of the clip to prevent movement of the clip with respect to the stringing cradle.

20 Claims, 7 Drawing Sheets

EQUIPMENT FOR STRINGING A TENNIS RACKET

This is a continuation of application Ser. No. 07/470,739 filed Jan. 26, 1990, now U.S. Pat. No. 5,026,055.

The invention relates to equipment, a device or a machine, which allows stringing of a tennis racket.

According to the French certificate of addition 43,577, equipment of this type has been described, comprising:

a support;

a stringing cradle, having the shape of a racket frame, rotationally mounted on the support and the angular position of which in relation to the support is adjustable; on the outer side, and on its periphery, this cradle has a plurality of braces, each provided with several adjustment grooves which are perpendicular, in other words directed towards the center of the frame;

a rigid but movable means of fixing the frame of the racket on the stringing cradle, comprising a plurality of independent fixing elements which can be brought opposite one another movably and adjustably on the various braces of the cradle by virtue of threaded rods with wing-nuts belonging to the said elements respectively; each fixing element has a gripping jaw, directed and open towards the frame of the racket, having two parallel cheeks which can be displaced together, moving towards or away from each other, by virtue of a manual control mechanism with a pinion and screw; the gripping jaw is completed on its outer edge by a lateral stop which can be adjusted translationally independently of the cheeks.

Such a machine has the following disadvantages.

The positioning and removal of a same frame take place by manual control of the many mechanisms combined with the various fixing elements respectively, since each has a minimum of one adjustment of the cheeks of the gripping jaw and one adjustment of the lateral stop.

In addition, for different frames, all or some of the fixing elements must be disassembled and reassembled differently on the same braces or different braces. The inner linings of the gripping cheeks must also be change to match the particular racket frame to be strung.

According to the document U.S. Pat. No. 4,706,955, stringing equipment has been proposed comprising:

a rigid support;

a stringing cradle which essentially consists of a bar, rotationally mounted on the support and the angular position of which in relation to the support is adjustable by the operator;

a rigid but movable means of fixing the frame of the racket on the stringing cradle; this means, provided on the cradle, comprises two elements for fixing the frame, arranged opposite one another and translationally adjustable on the bar; each fixing element comprises a bracket and a horizontal pressure means mounted on the head of the bracket; the two pressure means face each other and enable the wedge and the head of the racket frame to be gripped respectively; a first pressure means consists of a stationary bearing surface and an adjustable stop with a nut;

the lateral means or stops, on the outside, of the frame of the racket to be strung; these means consist in allocating to one of the fixing elements two arms which extend parallel to the stringing cradle, symmetrically in relation to the bar forming the stringing cradle; these two arms are articulated together on the bracket head, in an adjustable manner, between an averted position releasing the frame and a close position forming a stop against the outside of the frame, by suitably arranged movable rollers;

a tensioning element for the stringing thread, integral with the support, located at a distance from the stringing cradle and comprising a thread drawing head.

Such equipment has the following disadvantage:

The holding of the frame of the racket appears irregular, since the only points or zones of firm fixing consist of the pressure means explained above. In this respect, the above-described lateral stops do not ensure any rigid fixing of the frame of the racket capable of checking localized deformations of the frame under the effect of the tension exerted on the stringing thread. These stops can only limit the outward transverse displacement of the frame, and nothing else.

The two above-described pieces of equipment have in common the following main disadvantage:

The shapes, geometrical designs and dimensions of the frame, which vary from one racket to another, result in the level or the height of the horizontal stringing plane, in other words of the string mesh of the racket when strung or to be strung, in relation to the stringing cradle or to the rigid support, varying from one racket to another. Consequently, the level of the thread drawing head, or bobbin, varies significantly in relation to the stringing plane from one racket to another.

According to the French certificate of addition 43,577, this variation exists because of the independence of the various fixing elements which can move relative to the stringing cradle, and because of the differentiated spacings, tolerances or wears between the various fixing elements.

According to the document U.S. Pat. No. 4,706,955, this variation exists because of the fixed nature of the support plane of the frame, determined by the two stationary bearing surfaces of the two pressure means respectively, and because of the geometrical variations in the racket frames placed on the support.

As a result of the impossibility of controlling the level or height of the stringing plane, the tension effectively exerted on the stringing thread cannot be kept under control, taking into account the existence of a variable vertical constituent in the tension.

The subject of the present invention is stringing equipment which affords, primarily, effective control of the height or level of the stringing plane, whatever the racket. The subject of the invention is, secondarily, a device which affords simultaneously an effective and relatively complete clamping of the frame of the racket and ease of use for the operator According to the present invention, a reference plane, termed stringing plane, situated at a predetermined level or height, in particular relative to the stationary support, is first of all defined by construction. The specific means or those which characterize the present invention are then organized relative to this reference plane in the following manner:

on the one hand, by virtue of means of control of the displacement of the gripping jaws, the latter are movable only in the reference plane between an averted position releasing the frame and a close position gripping the latter;

and on the other hand, each jaw comprises means of auto-positioning the frame of the racket, under the effect of the displacement of at least one gripping jaw from the averted position to the close position, to bring the plane of the string mesh of the racket into the reference stringing plane.

A preferred, but not exclusive, embodiment of the invention concerns equipment comprising in the conventional manner two fixing elements for the frame, situated opposite one another on the stringing cradle, and each comprising a bracket. According to this embodiment, at least two gripping jaws are integral with two arms respectively, forming clamping elements for the frame of the racket; these arms extend above the stringing cradle and are each mounted on the head of a bracket, being adjustable, and preferably concomitantly, between an averted position releasing the frame and a close position clamping the latter.

The invention thus allows the frame of the racket to be fixed in space, in the manner of a vice, in relation to a reference plane in which the stringing will be carried out.

Since the invention affords control of the level of the stringing plane, a preferred embodiment of the invention consists in providing a drawing head for the stringing thread, separate from the rest of the tensioning element, and height adjustable in relation to the latter, and means of control which allow the drawing head to be positioned on the one hand in a low position, retracted in relation to the handle of the racket, when the angular position of the cradle lies within a reference angle corresponding to the passage of the handle on the side of the tensioning element, and on the other hand in a high position, coinciding for the stringing thread to be drawn with the reference stringing plane, and this when the angular position of the cradle lies outside the aforementioned reference angle.

This solution makes it possible to draw the stringing thread horizontally and to eliminate the vertical constituent in the tension exerted, over the major part of the angular course of the stringing cradle. Thus a major proportion of the pernicious constraints exerted according to the prior art on the mechanical components or elements supporting the racket is eliminated. A proportion of the friction on the thread upon being conducted through the frame is also eliminated, which improves precision with regard to the actual value of the tension of the thread.

Lastly, according to one variant of the invention, in a manner which is known per se, one or several clips are used for gripping the stringing thread, of each of which the position is movable in the stringing plane or the plane of the string mesh, and each of which swivels about a swivel pin perpendicular to the string mesh. These clips comprise, also in known manner, two cheeks opposite one another with an upper edge in the form of a comb, and means for moving the two cheeks towards or away from one another.

In a novel manner, according to the invention, each gripping clip is movable in the stringing plane about two hinge pins, mutually connected but separate, perpendicular to the stringing plane, namely:

a first hinge pin, rotationally fixed in relation to the stringing cradle, and about which a satellite arm is rotationally mounted, parallel to the cradle, and a second hinge pin, rotationally fixed in relation to the satellite arm, and about which a clip holder arm is rotationally mounted, parallel to the cradle.

Locking means are also provided to lock in position simultaneously both the satellite arm in relation to the cradle, and the clip holder arm in relation to the satellite arm.

Such an arrangement makes it possible to move the gripping clips very easily into plane of the string mesh at the same time as increasing the range of excursion of these latter, which allows the stringing of both large and small string meshes.

The present invention will now be described with reference to the attached drawings, in which.

Figure 1:
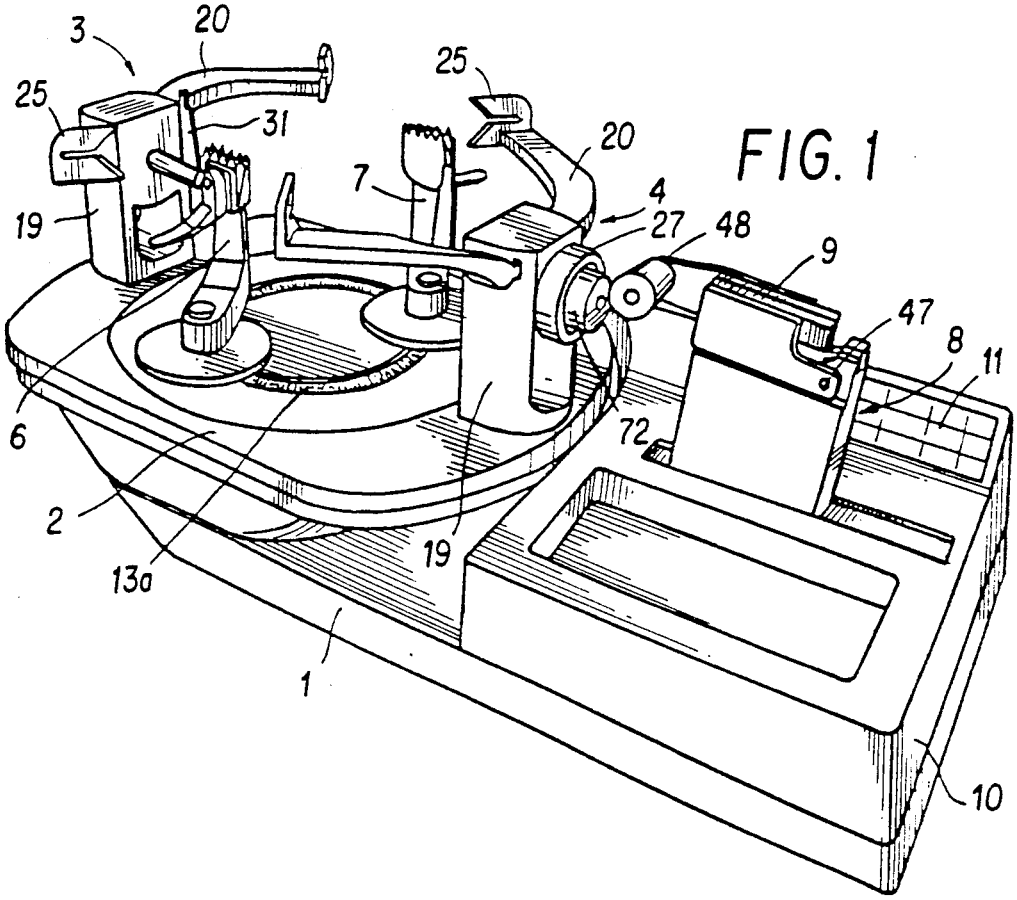
FIG. 1 represents a view in perspective of a device according to the invention.

In accordance with FIG. 1, equipment according to the invention comprises the following essential elements or components:

a rigid support 1, which can be placed on any flat and horizontal surface or on a height adjustable base or underframe; this support has, for example, a rectangular shape.

a stringing cradle 2, rotationally mounted on the support 1, and having an adjustable angular position in relation to the latter.

two fixing elements 3 and 4 for the frame of the tennis racket, arranged and fixed on the cradle 2, opposite one another about the axis of the frame.

two gripping clips 6 and 7 for the stringing thread, mounted in a movable manner on the stringing cradle 2.

a tensioning element 8 for the stringing thread, integral with the support 1, and comprising a drawing head 9 for the said thread.

a housing 10, arranged on both sides of the tensioning element 8 for the stringing thread, and comprising a control keyboard 11 facing towards the operator and allowing the operator to carry out the different movements necessary for the stringing of the racket.

Figure 2:
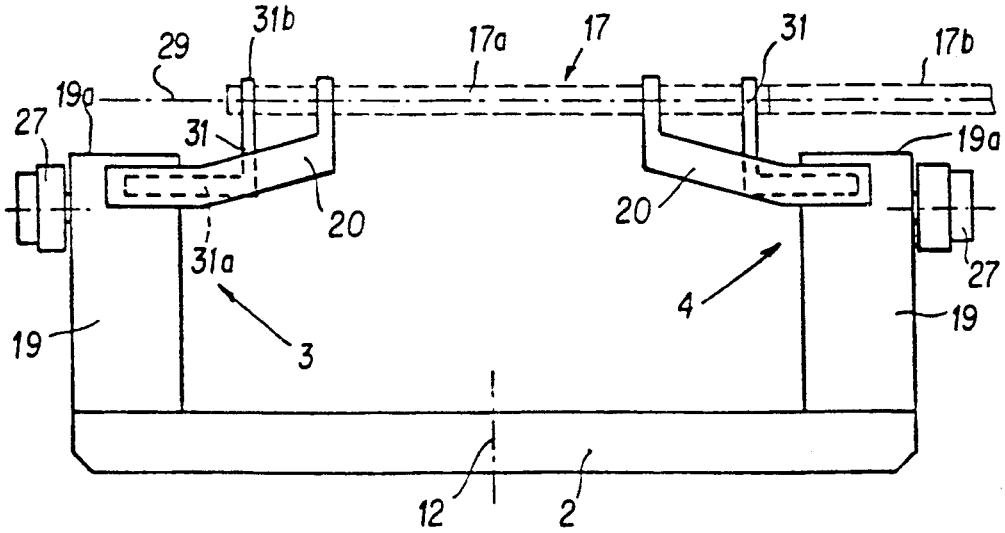
FIG. 2 represents a schematic view, from the front, of the stringing cradle forming part of the device represented in FIG. 1.
Figure 3:
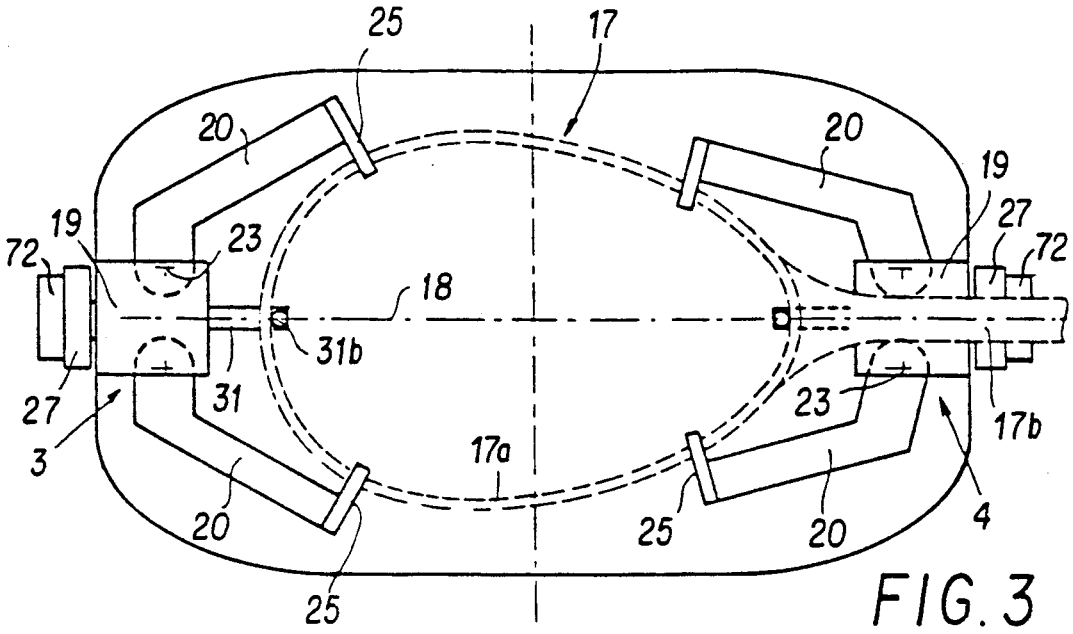
FIG. 3 represents a plan view of the said cradle, also schematically.
Figure 6:
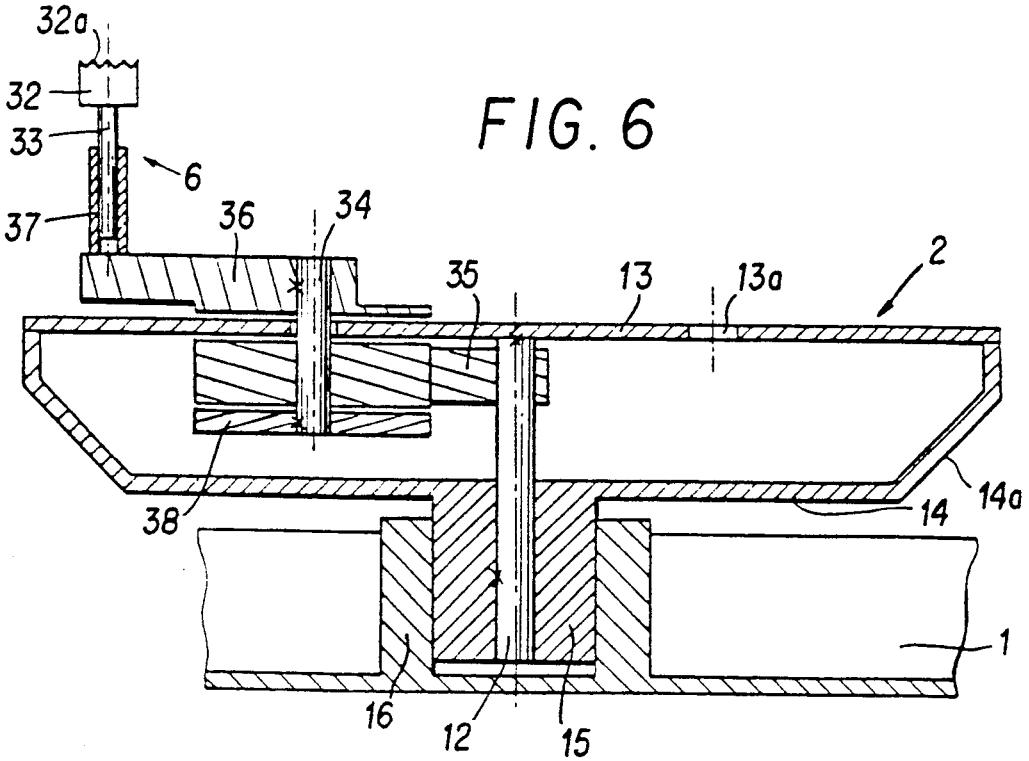
FIG. 6 represents schematically and in vertical section a view of the stringing cradle belonging to the equipment according to FIG. 1, this drawing representing more particularly the connection between the clip holder or holders and the stringing cradle.

In accordance with FIGS. 2, 3 and 6, the stringing cradle 2 has a flat shape and is mounted rotationally about a hinge pin 12, perpendicular to the support 1. More specifically, the cradle 2 comprises an upper platform 13, and a lower platform 14 arranged at a distance from the platform 13 and connected to the latter by an angled edge 14*a*. The cradle 2 is integral with a co-axial hub 15, swivel-mounted in a cylindrical housing 16, which is also co-axial and belongs to the support 1.

The two fixing elements 3 and 4 ensure the horizontal clamping in position of the tennis racket 17 to be strung, represented in broken lines in FIGS. 2 and 3, and comprising a frame 17*a* and a handle 17*b*. The two elements 3 and 4 are arranged in exactly the same way so that it is sufficient to describe only one of them, for example fixing element 3. The elements 3 and 4 are arranged and mounted rigidly on the cradle 2, opposite one another about the longitudinal axis 18 of the latter, which corresponds to the axis of symmetry of the racket 17. The fixing element 3 comprises a bracket 19, running perpendicularly to the cradle 2, two clamping arms 20 for the frame, which extend substantially parallel to the cradle 2, symmetrically in relation to the alignment axis 18 of the fixing elements 3 and 4. The general shape of these arms 20, seen from above (compare FIG. 3) matches the rounded profile of the frame 17*a*. The two arms 20 are each articulated on the head 19*a* of the bracket 19, adjustably and concomitantly, between an averted position represented in FIG. 5, releasing the frame 17*a* of the racket, and a closed position represented in FIG. 3, fixing and locking the said frame 17*a*, in the direction of the arrows represented by FIG. 5.

Figure 5:
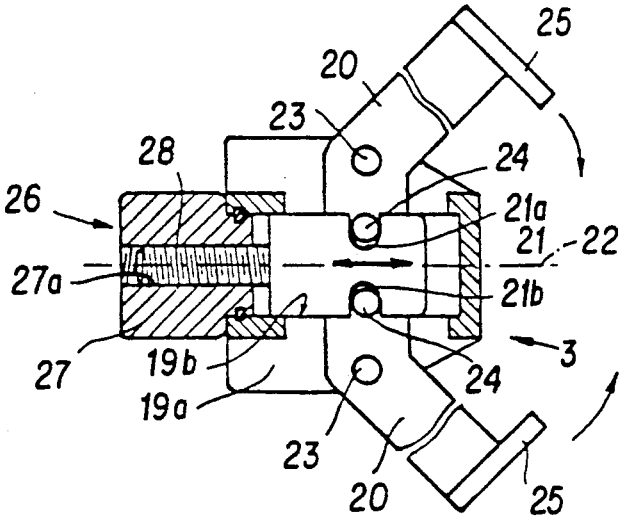
FIG. 5 represents schematically and in horizontal section a fixing element for the frame of the racket, at the level of the head of the bracket belonging to the said element.

The adjustable and concomitant articulation of the clamping arms 20 is achieved according to the embodiment represented in FIG. 5:

a slide 21 is mounted in the head 19*a* of the bracket and is translationally movable in the vertical alignment plane 22 of the fixing elements 3 and 4; this slide 21 comprises two aligned grooves 21*a* and 21*b*, which run perpendicularly to the aforementioned vertical plane 22.

two hinge pins 23 of the two arms 20 respectively, run perpendicularly to the stringing cradle 2 and downwards; these two hinge pins are swivel-mounted on the head 19*a* of the bracket 19, on both sides of the cylindrical orifice 19*b* which provides for the sliding travel of the slide 21.

two fingers 24 are arranged on the two extremities of the two arms 20 respectively at the opposite end to the jaws 25 described below, which fingers are engaged respectively in the grooves 21*a* and 21*b*.

an element 26 for adjusting the position of the slide 21 in the bracket head 19*a* comprises a knurled knob 27, which can turn freely in relation to the head 19*a* and which is situated most importantly on the outside of the bracket 19, and a threaded rod 28, coaxial with the slide 21 and which interacts with a homologous threading of an inside screw 27*a* provided along the axis of the knurled knob.

Figure 4:
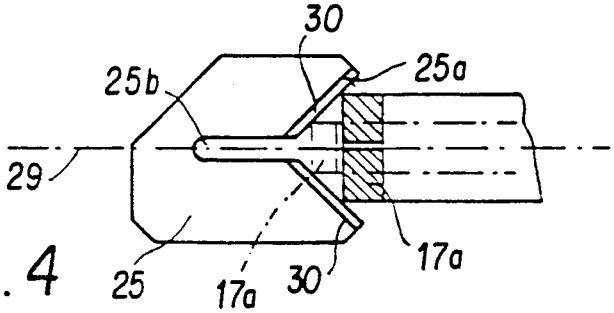
FIG. 4 represents schematically and in cross section a jaw forming part of any one of the clamping arms for the frame of the racket, which are also represented in FIGS. 2 and 3.

The free extremity of each clamping arm 20 comprises a gripping jaw 25, directed and open towards the frame 17*a* of the racket, and more specifically represented in FIG. 4. Each of these jaws has a flattened shape and runs substantially perpendicularly in relation to the frame 17*a* of the racket. The opening 25*a* of each jaw 25 has a diverging transverse profile, which is V-shaped and symmetrical in relation to the reference plane 29 which will be described below. The internal wall of each jaw 25, and more specifically of the opening 25*a*, is covered with a molded trim 30, made of plastic material, in order to favor the limited displacement of the frame 17*a*, without damaging it, when the clamping arms 20 are moved towards the racket 17, in the direction of the arrows represented in FIG. 5. The two angled edges, or cheeks of the opening 25*a* of each jaw 25, end in a passage or slot 25*b* between them, which extends behind the opening 25*a* and allows the passage of the stringing thread.

As shown in FIGS. 2 and 3, the two arms 20 of the first fixing element 3 are directed towards the two arms 20 respectively of the second fixing element 4, in order to contain the frame 17*a* of the racket. As shown in FIG. 4, the four matching jaws 25 extend vertically and symmetrically on both sides of the reference stringing plane 29. This, in association with the technical characteristics previously described, makes possible auto-positioning and clamping of the frame 17*a* of the racket, in the reference plane 29 parallel to the cradle 2, under the effect of the displacement of the clamping arms 20, in the direction of the arrows represented in FIG. 5, from the averted position to the close position previously described. During the movement of the jaws 25, from the outside towards the inside of the cradle 2, the frame 17*a*, whatever its geometry, size or thickness, is centered in the reference stringing plane 29; this is shown in particular by FIG. 4, in which two frames 17*a* of different thickness and dimensions have been represented.

As shown also in FIG. 2, the reference stringing plane, which corresponds to what will be the string mesh of the racket 17 and is determined by the gripping jaws 25, is situated above the heads 19*a* of the fixing brackets 19.

To complete the description of the fixing elements 3 and 4 it is necessary to point out that each of them has a hook 31, or billet, which makes it possible to hold the frame 17*a* of the racket firmly in position and completes the fixing action of the jaws 25.

Figure 14:
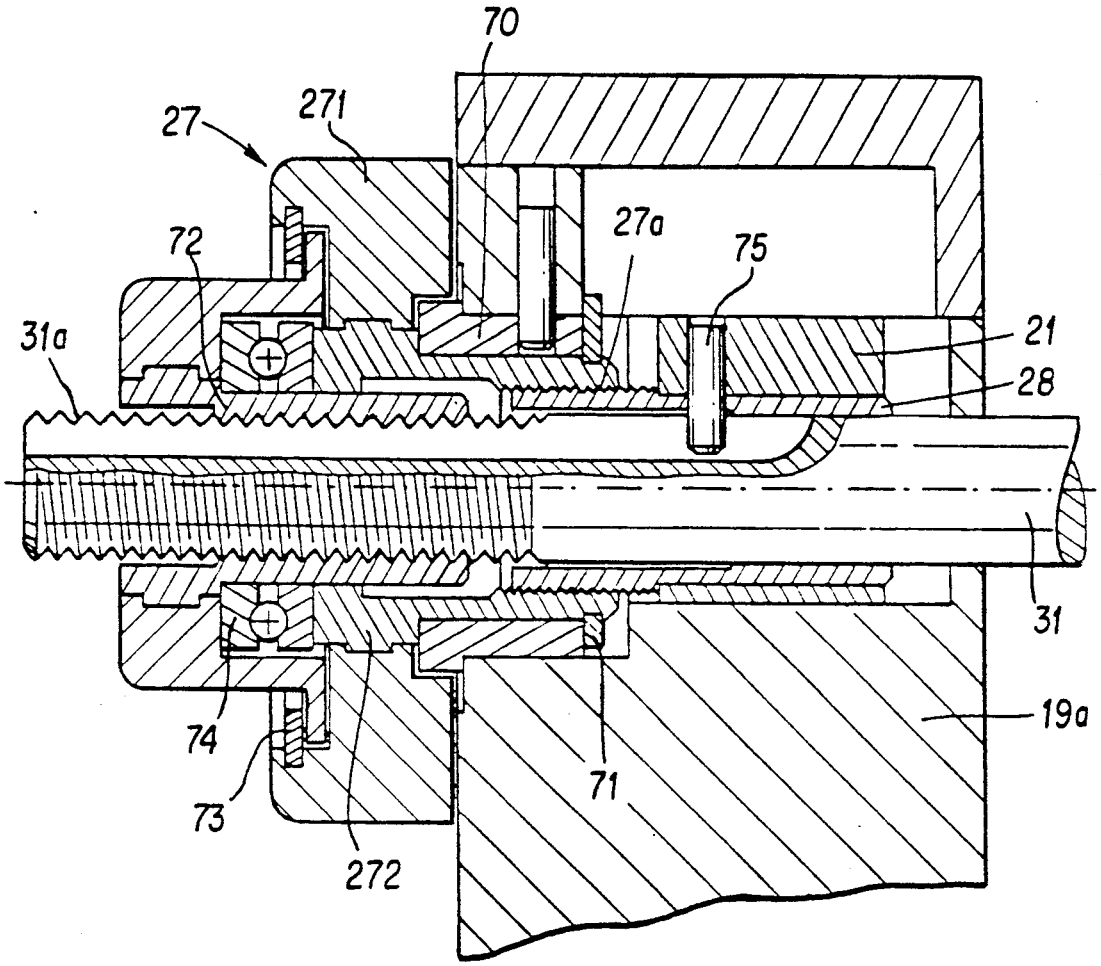
FIG. 14 represents in vertical section an embodiment of the fixing element also represented schematically in FIG. 5. This Figure illustrates the separate controls of the billet and the clamping arms respectively.

Each billet 31 is operated and translationally adjusted, in relation to the bracket head 19*a*, independently of the clamping arms (20) for the frame. To this end, the embodiment according to FIG. 14 can be used, briefly described as follows:

a first knurled knob 27 comprises two parts 271 and 272, rotationally integral with one another; the first 271 is situated on the outside of the head 19*a*, and can be manipulated by the operator; the second 272 is mounted freely rotationally on a ring attached to the top of the head 19*a*, and translationally stopped by a washer 71; it is this piece 272 which comprises the threading 27*a* which interacts with the hollow threaded rod 28 which is integral with the slide;

a second knurled knob 72 is mounted freely rotationally on the first knob 27, and more specifically the part 271, by means of a stop ring 73 and a radial ball bearing 74 between the pieces 72 and 272;

the barrel 72*a* of the knurled knob 72 comprises an inside thread which interacts with the threaded extremity 31*a* of the straight rod 31 of the billet; the latter slides freely on the inside of the tube 28 which is integral with the slide 21, and the rod 31 is rotationally stopped by a pin which is integral with the slide.

Thus each billet can be brought firmly up against the frame by the operator and makes it possible to avoid any serious longitudinal displacement of the frame during stringing.

In a manner known per se, the two gripping clips 6 and 7 for the stringing thread each comprise two opposite cheeks, of which only one 32*a* has been represented in FIG. 6, the upper edge 32*a* of the said cheek having the shape of a comb, in order to allow the passage of the transverse threads of the string mesh. For each gripping clip, 6 or 7, means (not shown) are provided for moving the two cheeks 32 together and apart.

Figure 7:
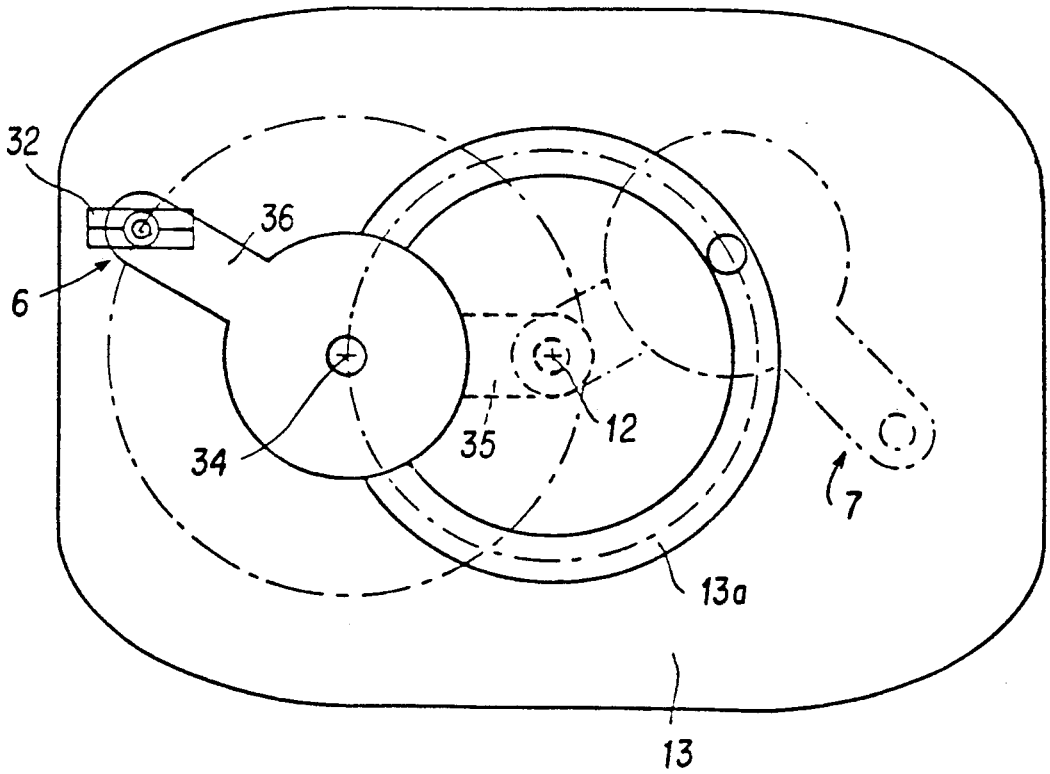
FIG. 7 represents a plan view of the stringing cradle, corresponding to the representation in FIG. 6.

In accordance with FIGS. 6 and 7, the two gripping clips 6 and 7 can simultaneously be displaced in the stringing plane and swivelled about their own swivel pin 33, perpendicular to the cradle 2, or to the aforementioned stringing plane To this end the two clips 6 and 7 are arranged in exactly the same way in relation to the cradle 2, so that the description of the arrangement of the clip 6 alone is sufficient, in accordance with FIGS. 6 and 7.

According to this arrangement, the gripping clip 6 is movable in the aforementioned stringing plane, about two hinge pins 12 and 34, connected but separate, and both perpendicular to the said stringing plane. About the first hinge pin 12, fixed rotationally in relation to the stringing cradle 2, a satellite arm 35 is rotationally mounted, parallel to the cradle 2. About the second hinge pin 34, rotationally fixed in relation to the satellite arm 35, a clip holder arm 36 is rotationally mounted, also parallel to the cradle 2. This clip holder arm supports a vertical barrel 37, in the center of which the swivel pin 33 of the clip 6 is arranged. The upper platform 13 of the cradle 2 comprises a circular aperture 13*a*, centered on the first hinge pin 12. The satellite arm 35 is situated below the platform 13, and the clip holder arm 36 above this platform, the second hinge pin 34 passing freely through the circular aperture 13*a*.

According to the invention there are of course provided means for simultaneous locking in position, described below, both of the satellite arm 35 in relation to the cradle 2 and of clip holder arm 36 in relation to the satellite arm 35.

Figure 11:
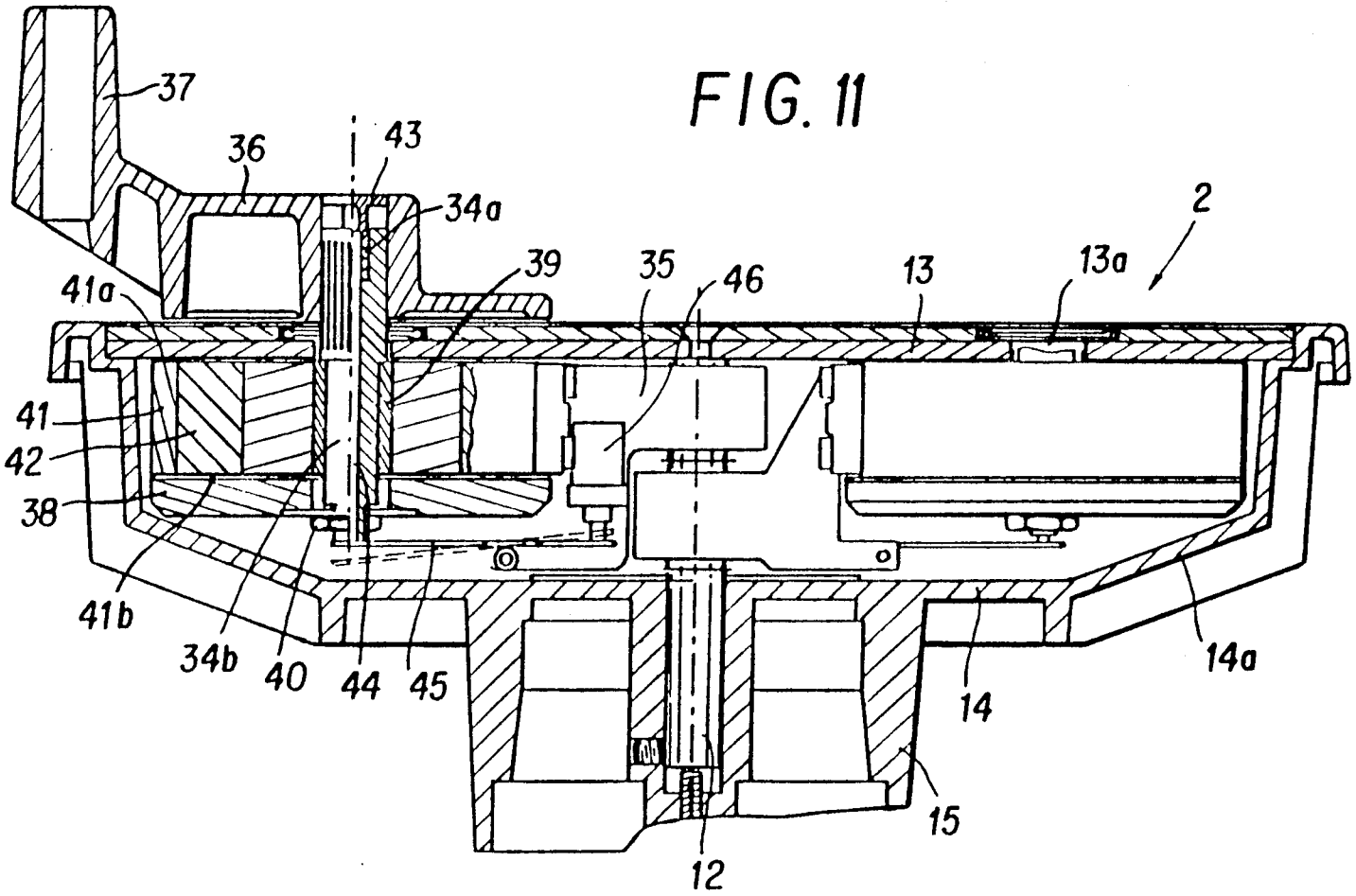
FIG. 11 represents in vertical section an embodiment of the stringing cradle which is also represented schematically in FIG. 6; the fixing elements for the frame of the racket have not been shown in the representation in this Figure.

In accordance with FIG. 11, which represents an embodiment of the schematic diagram explained in FIG. 6, the identical numerical references designate components or pieces which have the same functions as previously described. The means for locking in position result from the combination of the following means:

the second hinge pin 34 is mounted freely rotationally in a sleeve 39 which is integral with the satellite arm 35.

the clip holder arm 36 is rotationally fixed on the outer and upper extremity 34*a* of the second hinge pin 34 by means of a suitable knurling.

an end plate 38 is rotationally fixed, by a nut 40, on the inner and lower extremity 34*b* of the hinge pin 34, parallel to the platform 13.

an electromagnet 41 with a coil 42 on top which is centered on the second hinge pin 34, is integral with the satellite arm 35, between the end plate 38 and the platform 13; the satellite arm 35 is translationally free, in a limited travel, in relation to the second hinge pin 34, and the electromagnet 41 has two opposite active faces, namely one 41*a* opposite the metallic platform 13, and the other 41*b* opposite the metallic end plate 38.

an electric means of control for the electromagnet 41 comprises:

1. a push button 43 translationally guided in an axial boring in the upper extremity 34*a* of the hinge pin 34, 2. a control rod 44, arranged co-axially in the hinge pin 34*a* and translationally free in relation to this latter, 3. a lever 45, integral with the satellite arm 35, and articulated on this latter, connected at one extremity with the control rod 44, 4. a contactor 46, integral with the satellite arm 35, connected to the other extremity of the lever 45.

By virtue of this arrangement and suitable electric power supply to the electromagnet 41, when the operator presses the button 43, the lever 45 swings towards the contactor 46, to supply the coil 42; from this moment the active face 41*a* of the electromagnet comes into contact with the platform 13, and the satellite arm 35 rises slightly, whereas the active face 41*b* raises and attracts the end plate 38.

The means previously described thus permit on the one hand the rotational locking of the satellite arm 35 in relation to the platform 13 and therefore to the cradle 2, and on the other hand the rotational locking of the clip holder arm 36 in relation to the satellite arm 35.

Figure 8:
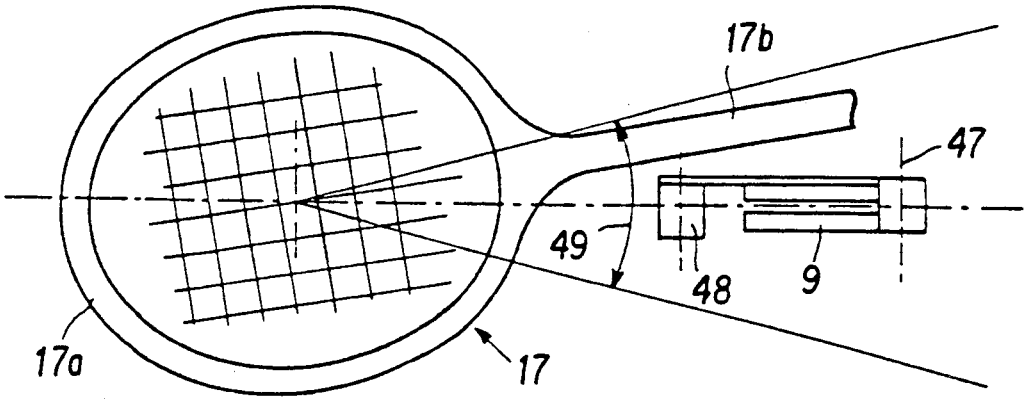
FIG. 8 represents schematically and in plan view the relationship between the rotation of the stringing cradle, which supports the frame of the racket, on the one hand, and the tensioning element for the stringing thread, and more specifically the drawing head for this latter, on the other.
Figure 9:
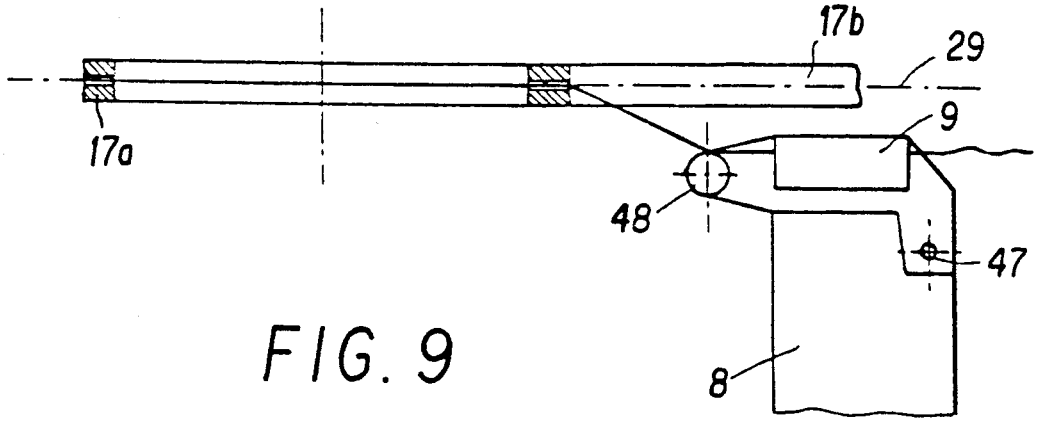
FIGS. 9 and 10 represent the position of the drawing head of the stringing thread, in low and high position respectively, in relation to the horizontal plane of the frame of the racket.
Figure 10:
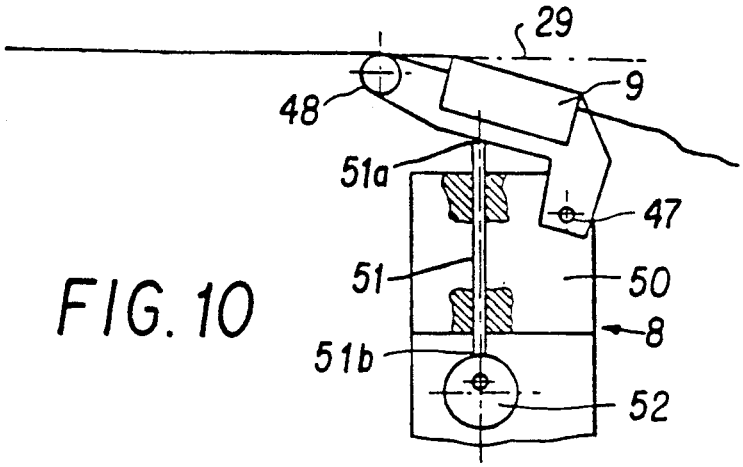
Figure 13:
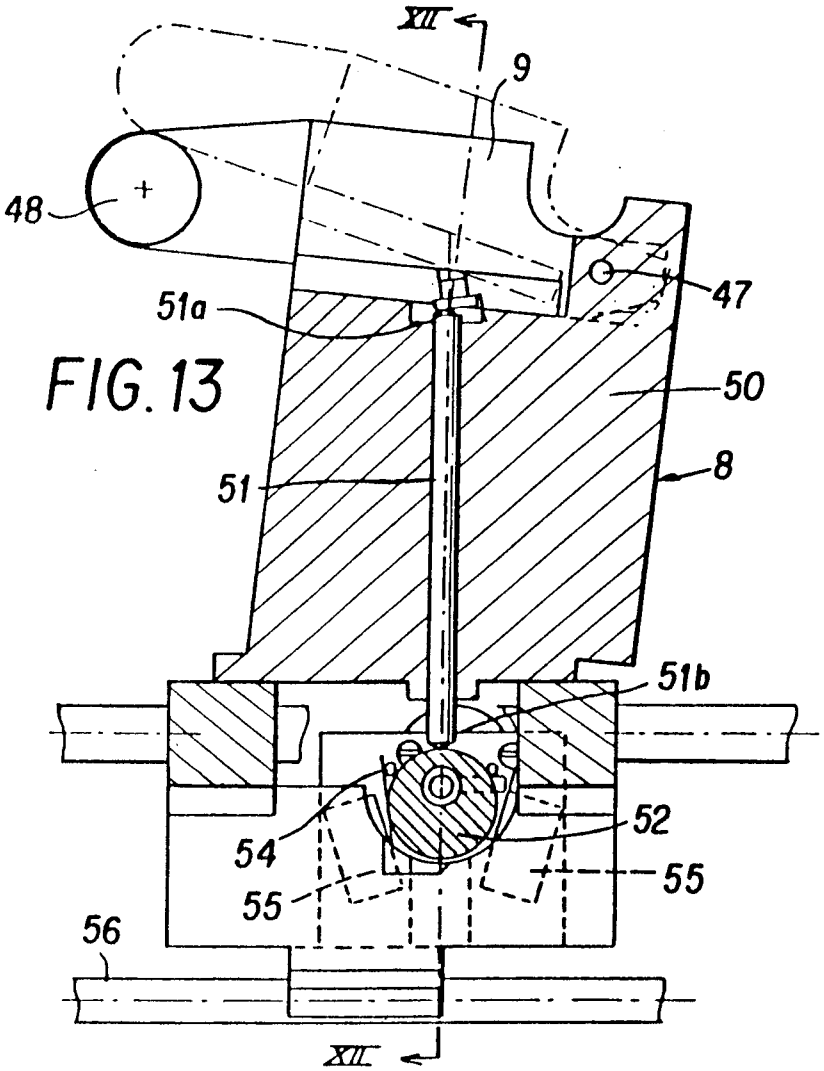
FIG. 13 represents a sectional view, along the line XIII.XIII of FIG. 12, of the said tensioning element.
Figure 12:
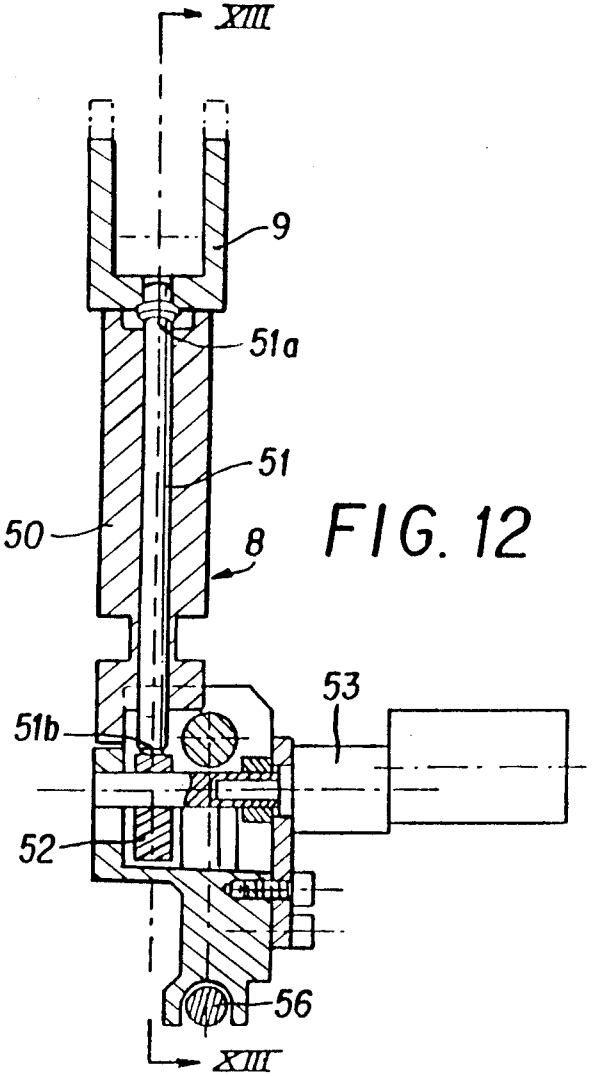
FIG. 12 represents, along the section line XII.XII of FIG. 13, an embodiment of the tensioning element for the stringing thread.

In accordance with FIGS. 8 to 10, the drawing head 9 for the stringing thread is separate from the rest of the tensioning element 8, and is articulated on the element 8, about a horizontal hinge pin 47. This head 9 comprises, in a manner known per se, on the one hand a roll 48, or bobbin, for the unrolling of the stringing thread, and on the other hand gripping cheeks for the said thread, which are not shown. By pivoting about the pin 47, the drawing head 9 is height adjustable, in relation to the element 8, between a low position (compare FIG. 9), retracted in relation to the handle 17*b* of the racket, and a high position (compare FIG. 10) which coincides for the stringing thread to be drawn, or the upper tangent plane of the bobbin 48, with the reference stringing plane 29, described and defined above. By virtue of the means of control described below, the retracted position according to FIG. 9 is obtained when the angular position of the cradle 2, defined by the angular position of the handle 17*b*, lies within a reference angle 49, corresponding to the passage of the handle 17*b* on the side of the tensioning element 8. The high position according to FIG. 10 is obtained when the angular position of the cradle lies outside the reference angle 49. According to the schematic diagram in FIG. 10 and the embodiment in FIGS. 12 and 13, the means of control of the drawing head 9 is arranged in the following manner.

The tensioning element 8 comprises a column 50 on the head of which is articulated the drawing head 9. A control rod 51 slides in the column 50 and at its upper extremity 51*a* bears against the drawing head 9. A cam 52 is rotationally mounted on the base of the column 50, and is in contact with the lower extremity 51*b* of the rod 51. An electric motor 53 drives the cam 52 rotationally. The rotational travel of the cam 52 is limited to a half-revolution, by means of a finger 54, rotationally integral with the aforementioned cam and situated outside the element 8, which interacts with two limit of travel contactors 55. By means of two bosses situated on the support, and which delimit the reference angle 49, the electric motor 53 for control of the cam 52 is activated or deactivated according to whether a specific contactor on the periphery of the cradle 2 is engaged or disengaged by any one of the aforementioned bosses.

The tensioning element 8 slides on a ball bearing runner 56, and is drawn towards the rear of the equipment by a motorized pinion and a chain, which are not shown. Operation of the motor 53, in order to raise the drawing head 9 to the level of the reference plane 29, takes place before tensioning of the stringing thread, by the motorized reverse movement, as previously described, of the element 8.

I claim:

1. Equipment for stringing a racket having a string mesh plane, comprising:

a stringing cradle having a reference stringing plane;

a first pair of opposed gripping jaws;

at least one said jaw of said first pair of gripping jaws being movably mounted for movement between an open position releasing the racket and a closed position gripping the racket; and said first pair of gripping jaws cooperating to position the string mesh plane of the racket in the reference stringing plane upon displacement of said at least one gripping jaw from the open position to the closed position.

2. Equipment as in claim 1, wherein said gripping jaws have a diverging transverse profile which is symmetrical in relation to the reference stringing plane.

3. Equipment as in claim 2, wherein said gripping jaws are V-shaped.

4. Equipment as in claim 1, wherein each jaw of said first pair of gripping jaws is movably mounted between an open position releasing the racket and a closed position gripping the racket.

5. Equipment as in claim 1, further comprising a second pair of opposed gripping jaws cooperating with said first pair of gripping jaws to position the string mesh plane of the racket in the reference stringing plane upon displacement of said at least one gripping jaw from the open position to the closed position.

6. Equipment as in claim 5, wherein at least one jaw of said second pair of gripping jaws is movably mounted for movement between an open position releasing the racket and a closed position gripping the racket.

7. Equipment as in claim 5, wherein each jaw of said first pair of gripping jaws and each jaw of said second pair of gripping jaws is movably mounted for movement between an open position releasing the racket and a closed position gripping the racket.

8. Equipment as in claim 5, wherein each jaw of said second pair of gripping was has a diverging transverse profile which is symmetrical in relation to the reference stringing plane.

9. Equipment as in claim 8, wherein each jaw of said second pair of ripping jaws is V-shaped.

10. Equipment as in claim 5, wherein each jaw of said first pair of gripping jaws and each jaw of said second pair of gripping jaws has a diverging transverse profile which is symmetrical in relation to the reference stringing plane.

11. Equipment as in claim 10, wherein each jaw of said first pair of gripping jaws and each jaw of said second pair of gripping jaws is V-shaped.

12. Equipment as in claim 5, wherein said first pair of gripping jaws is mounted on a first pair of movable gripping arms, and sad second pair of gripping jaws is mounted on a second pair of movable gripping arms.

13. Equipment for stringing a racket, comprising:

a support;

a stringing cradle rotatably mounted on the support, wherein the angular position of the cradle with respect to the support is adjustable;

a racket holder mounted on the stringing cradle; and clips comprising two opposed comb-shaped cheeks movable toward and away from each other for gripping string strung on a racket mounted on the stringing cradle, the clips being rotatably mounted on the stringing cradle to maintain alignment of the clips with string strung on the racket.

14. Equipment as in claim 13, wherein the clips are rotatably mounted on the stringing cradle by:

a satellite arm mounted for rotation about an axis parallel to an axis of rotation of the stringing cradle on the support;

a clip mounting arm rotatably mounted on the satellite arm for rotation about an axis parallel to the axis of rotation of the stringing cradle and spaced from the axis of rotation of the satellite arm; and a lock which can simultaneously lock the satellite arm and the clip mounting arm against movement relative to the stringing cradle.

15. Equipment as in claim 14, wherein:

the stringing cradle includes an upper platform having a circular opening;

the center of the opening is coincident with the axis of rotation of the satellite arm; and the satellite arm is located below the upper platform, the clip mounting arm is located above the upper platform and the clip mounting arm is rotatably mounted on the satellite arm by a member which passes through the opening.

16. Equipment as in claim 15, wherein:

the clip mounting arm comprises a pin freely rotatably mounted on the satellite arm;

the clip mounting arm is fixed on an upper end to the pin;

the satellite arm is movable toward and away from the upper platform; and the lock comprises:

an end plate of magnetically attractable material fixed on the lower end of the pin, substantially parallel to the upper platform;

an electromagnet mounted on the satellite arm in centered relationship with the pin, the electromagnetic having two active faces, with one face disposed adjacent the end plate and the other face disposed adjacent the upper platform, the portion of the upper platform adjacent said one active face being electromagnetically attractive; and a controller for the electromagnet.

17. Equipment for stringing a string mesh on a racket, comprising:

a support;

a stringing cradle rotatably mounted on the support, whereby the angular position of the cradle with respect to the support is adjustable;

a racket holder mounted on the stringing cradle; and a string tensioner mounted on the support, the string tensioner including a drawing head for engaging racket string being strung on a racket mounted on the racket holder, said drawing head being mounted movably between an elevated position in which string received on the drawing head is positioned on a level with a string mesh of a racket mounted on the racket holder, and a retracted position in which the drawing head is below a racket mounted on the racket holder.

18. Equipment as in claim 17, wherein:

the drawing head is automatically positioned in the retracted position when the stringing cradle is positioned in an angular region corresponding to passage of a handle of a racket mounted on the racket holder in he location of the drawing head; and the drawing head is automatically positioned in the elevated position when the stringing cradle is positioned outside said angular region.

19. Equipment as in claim 18, wherein the string tensioner comprises:

a column on which the drawing head is pivotable between said elevated and retracted position;

a cam;

a control rod slidably mounted on the column with one end of the control rod in engagement with the drawing head and the other end of the control rod in engagement with the cam; and drive means for driving the cam, whereby the drawing head is positioned in said elevated position by the control rod.

20. Equipment as in claim 18, further comprising a string cradle position sensor which initiates movement of the drawing head to the retracted position upon sensing the position of the string cradle in said angular region.

* * * * *

UNITED STATES PATENT AND TRADEMARK OFFICE

CERTIFICATE OF CORRECTION

PATENT NO. : 5,080,360

DATED : Jan. 14, 1992

INVENTOR(S) : Gerard Longeat

It is certified that error appears in the above-identified patent and that said Letters Patent is hereby corrected as shown below:

Col. 2, line 54, after "operator" insert --.--.

Col. 7, line 23, after "plane" insert --.--.

Col. 8, line 12, change "," to --.--.

Claim 8, col. 9, line 51, change "was" to --jaws--.

Claim 9, col. 9, line 55, change "ripping" to gripping--.

Claim 12, col. 9, line 66, change "sad" to --said--.

Claim 16, col. 10, lines 47-48, change "electromagnetic" to --electromagnet--.

Claim 18, col. 11, line 10, change "he" to --the--.

Claim 19, col. 12, line 4, change "on" to --in--.

Signed and Sealed this

Fourteenth Day of September, 1993

Bruce Lehman

*Attest:*

BRUCE LEHMAN

*Attesting Officer*

*Commissioner of Patents and Trademarks*